33-657
E7145 OR 4,546,547

United States Patent [19]

Scheurecker et al.

[11] Patent Number: 4,546,547

[45] Date of Patent: Oct. 15, 1985

[54] CHECKING AND ALIGNING STAND TO BE USED IN A CONTINUOUS CASTING PLANT

[75] Inventors: Werner Scheurecker; Alois Scheinecker; Johannes Cordella, all of Linz; Kurt Engel, Leonding, all of Austria

[73] Assignee: Voest-Alpine Aktiengesellschaft, Linz, Austria

[21] Appl. No.: 409,507

[22] Filed: Aug. 19, 1982

[30] Foreign Application Priority Data

Sep. 22, 1981 [AT] Austria ..... 4066/81

[51] Int. Cl.[4] ..... G01B 5/25

[52] U.S. Cl. ..... 33/182; 29/464; 164/442

[58] Field of Search ..... 33/181 R, 182, 180 R, 33/147 L, 286; 29/407, 464; 164/442

[56] References Cited

U.S. PATENT DOCUMENTS 3,638,326 2/1972 Thompson et al. ..... 33/182
3,718,019 2/1973 Box et al. ..... 33/182
4,074,439 2/1978 Capriotti et al. ..... 33/182
4,085,513 4/1978 Capriotti et al. ..... 33/182

FOREIGN PATENT DOCUMENTS 360683 1/1981 Austria ..... 33/182

*Primary Examiner*—Willis Little
*Attorney, Agent, or Firm*—Brumbaugh, Graves, Donohue & Raymond

[57] ABSTRACT

A checking and aligning stand for measuring and aligning structure sections of the strand guide of a continuous casting plant includes measuring surfaces to determine the mounting position of the structure section. In order to be able to effect a quick check of the mounting position of curved structure sections of a bow-type continuous casting plant without impeding the casting operation during this adjustment work, at least two pairs of measuring surfaces arranged at an angle to each other, preferably at 90°, to determine the roller-way coordinates relative to the position-defining supporting surfaces of the structure section are provided on the checking stand.

5 Claims, 6 Drawing Figures

CHECKING AND ALIGNING STAND TO BE USED IN A CONTINUOUS CASTING PLANT

BACKGROUND OF THE INVENTION

The invention relates to a checking and aligning stand as well as a method for measuring and aligning structure sections of the strand guide of a continuous casting plant, in particular for the aligned adjustment of two structure sections neighboring in the strand flow direction, comprising measuring surfaces to determine the mounting position of the structure section.

A checking and aligning stand of this kind is known from U.S. Pat. No. 4,074,439. After placing a structure section onto this checking and aligning stand, the rollers are adjusted by means of a gauge having the cross sectional dimensions of the strand to be cast, whereby the central line of the structure is exactly brought into its ideal position. This known checking and aligning stand, however, is suited only to adjust vertical structure sections with vertical guideways for the strand.

The invention aims at avoiding this disadvantage and has as its object to provide a checking and aligning stand of the initially defined kind, by which the mounting position of curved structure sections of a bow-type continuous casting plant can be quickly checked and corrected, i.e., off from the continuous casting plant proper, so that the casting operation will not be impeded during the adjustment work. In particular, it is to be possible to determine and to correct the roller coordinates of the curved strand guide.

SUMMARY OF THE INVENTION

This object is achieved according to the invention in that at least two pairs of measuring surfaces arranged at an angle to each other, preferably at 90°, to determine the rollerway coordinates relative to the position-defining supporting surfaces of the structure section are provided on the checking stand.

According to a preferred embodiment the checking stand comprises horizontal and vertical measuring surfaces.

Suitably, the checking stand comprises a plurality of upright standards including seats for the structure section(s) arranged in accordance with the seats provided in the continuous casting plant, the measuring surfaces being designed as consoles fastened to the standards and projecting towards the structure section.

In order to be able to measure and adjust also the mounting position of the mould and its position relative to the subsequently arranged structure section, a horizontal and a vertical measuring surface are provided on the checking stand to determine the mounting position of the mould, these measuring surfaces being arranged such that the structure sections following upon the mould can be threaded through the checking stand without impediment.

A particularly simple method for aligning two structure sections neighboring in the strand flow direction and subsequently installing these structure sections into the continuous casting plant by using the checking and aligning stand according to the invention is characterized in that, at first, the lower structure section is inserted into the checking and aligning stand, measured and, if necessary, corrected, whereupon the upper structure section is inserted into the checking and aligning stand and adjusted so as to be in alignment with the lower structure section by a centering means insertable into the strand guide, that, afterwards, the two structure section are fixed relative to each other, lifted out of the checking and aligning stand together with the centering means and commonly inserted into the continuous casting plant, whereupon the centering means is removed from the strand guide.

BRIEF DESCRIPTION OF THE DRAWINGS

The invention will now be explained in more detail by way of two embodiments with reference to the accompanying drawings, wherein.

DESCRIPTION OF EXEMPLARY EMBODIMENTS

Figure 1:
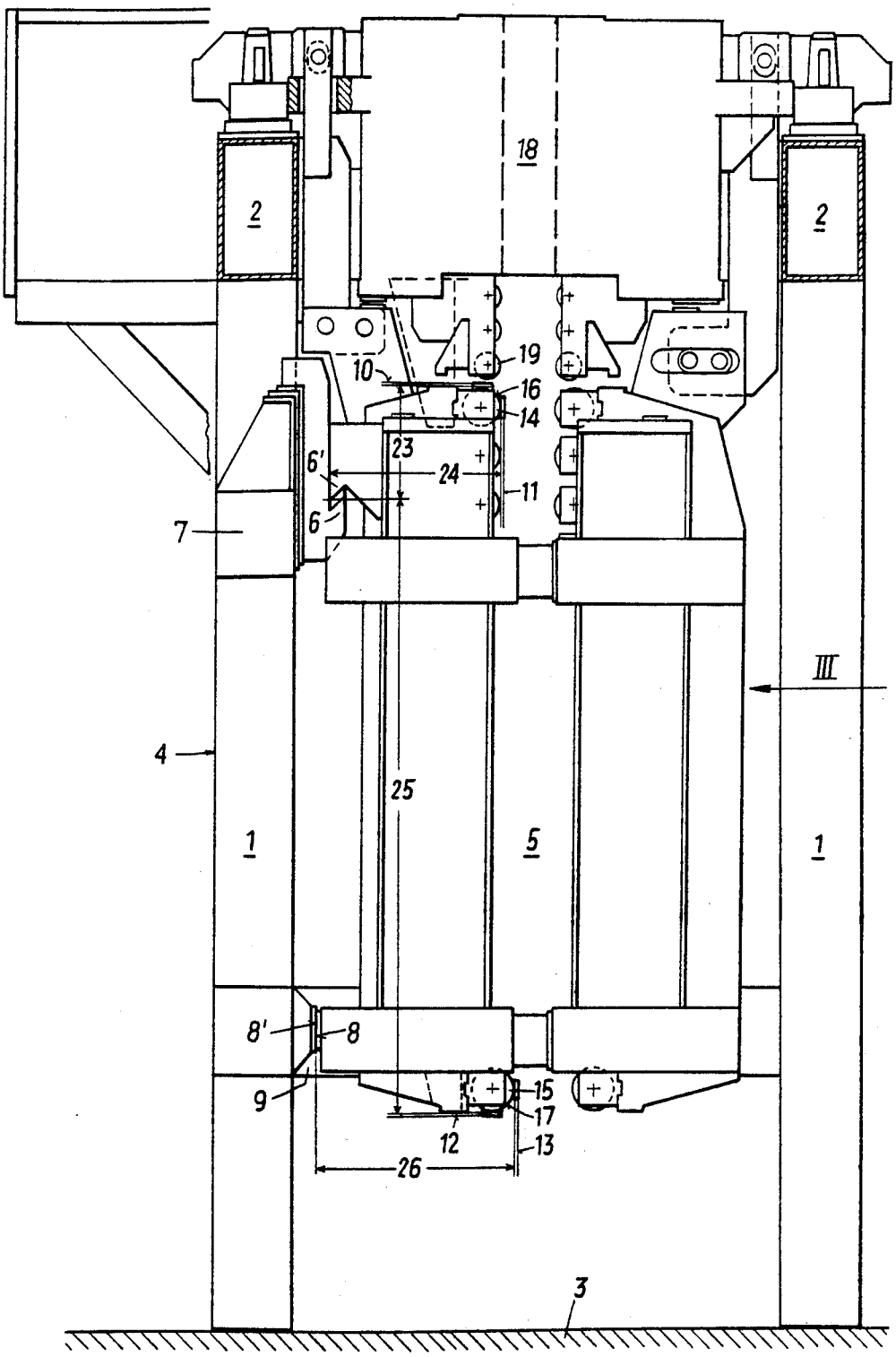
FIGS. 1 to 3 illustrations in partial section of a first exemplary embodiment of the present invention, FIG. 1 being a side view, FIG. 2 a top view, and FIG. 3 a side view taken in the direction of the narrow III of FIG. 1.

On four vertical standards 1, which are connected by means of transverse carriers 2 to form a stable rigid cage 4 supported on the base 3, the suspension means for the bending arrangement 5 (in the following called bending zone) of a bow-type continuous casting plant are provided. These suspension means are formed by an upper hook 6 fastened to a transverse carrier 7 of the cage 4, into which the bending zone 5 is suspendible by means of a counter hook 6', and a lower supporting surface 8 against which the bending zone 5 is supported via a counter supporting surface 8'. These suspension means are provided in the same design, arrangement and position to one another as the suspension means in the continuous casting plant itself.

On the cage 4, measuring surfaces 10 to 13 arranged on consoles 9 are rigidly arranged, each one reaching as far as to the first and to the last roller 14, 15 of the bending zone 5, i.e., two measuring surfaces 10, 11 or 12, 13, respectively, are provided for each of these rollers. One of the two measuring surfaces each is horizontally designed (measuring surface 10 or 12, respectively,) and the other one is vertically designed (measuring surface 11 or 13, respectively), so that the roller coordinates of these two rollers 14, 15 are precisely determinable. The measuring surfaces project beyond the roller surfaces 16, 17. By applying a ruler, the distance of the roller surfaces 16, 17 from the measuring surfaces 10 to 13 can be precisely measured.

On the upper transverse carriers 2 of the rigid cage 4, which correspond to the lifting table provided in the continuous casting plant, the mould 18 is placeable in the same manner as on the lifting table, so that even the position of the last foot roller 19 of the mould relative to the position of the uppermost (first) roller 14 of the bending zone 5 is checkable. Subsequently, the measure 20 from the fixed axis 21 of the mould 18 to its fixed side 22 is checked and, if necessary, corrected to the desired setmeasure.

The mould and the bending zone may then be removed from, and installed into, the continuous casting plant separately from each other.

By checking the positions of the first and last rollers 14, 15 of the bending zone 5 relative to the rigidly arranged measuring surfaces 10 to 13, the distances 23 to 26 of these rollers 14, 15 from the suspension means, i.e., from the upper hooks 6 and the lower supporting surface 8, are determinable so that these measures can be corrected to the desired set values, if necessary, thus ensuring that the bending zone 5, after suspension into the continuous casting plant, will be in strict alignment with the neighboring supporting segments.

Figure 3:
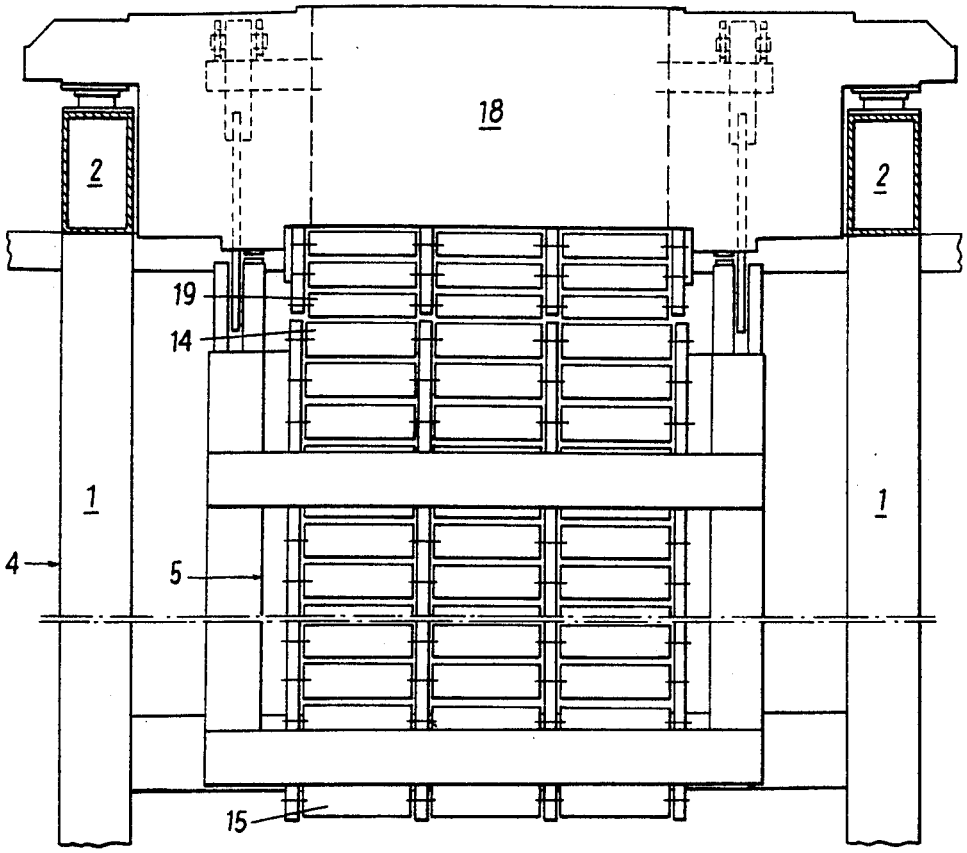
Figure 2:
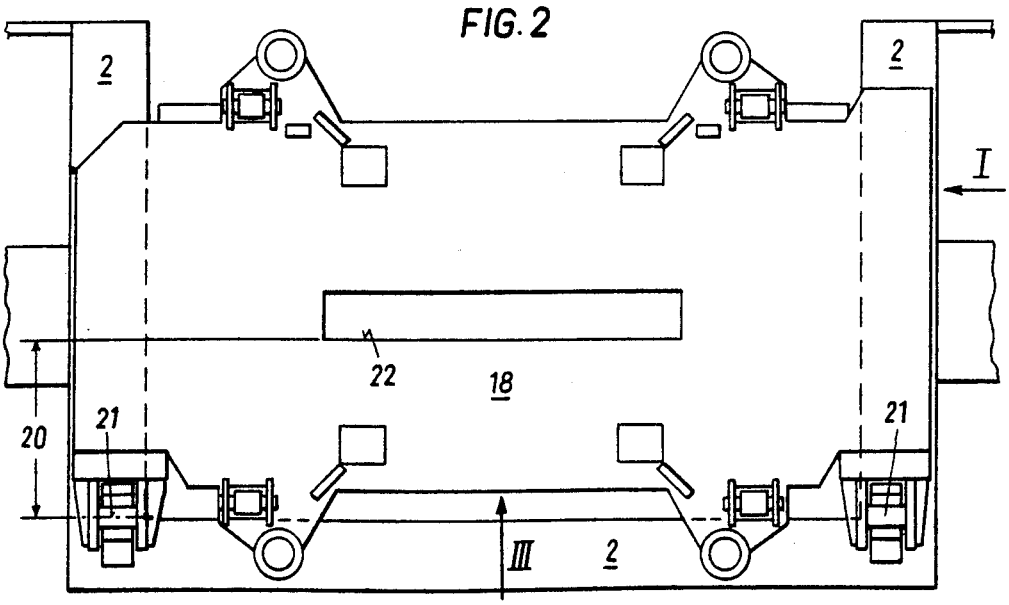

The embodiment according to FIGS. 1 to 3 is particularly suited for continuous casting plants already in operation. For newly built plants it is suitable to measure the mould and the bending zone commonly at one checking stand as illustrated in FIGS. 4 to 6 and subsequently described, to fix them relative to each other and to commonly install them into the continuous casting plant.

Figure 4:
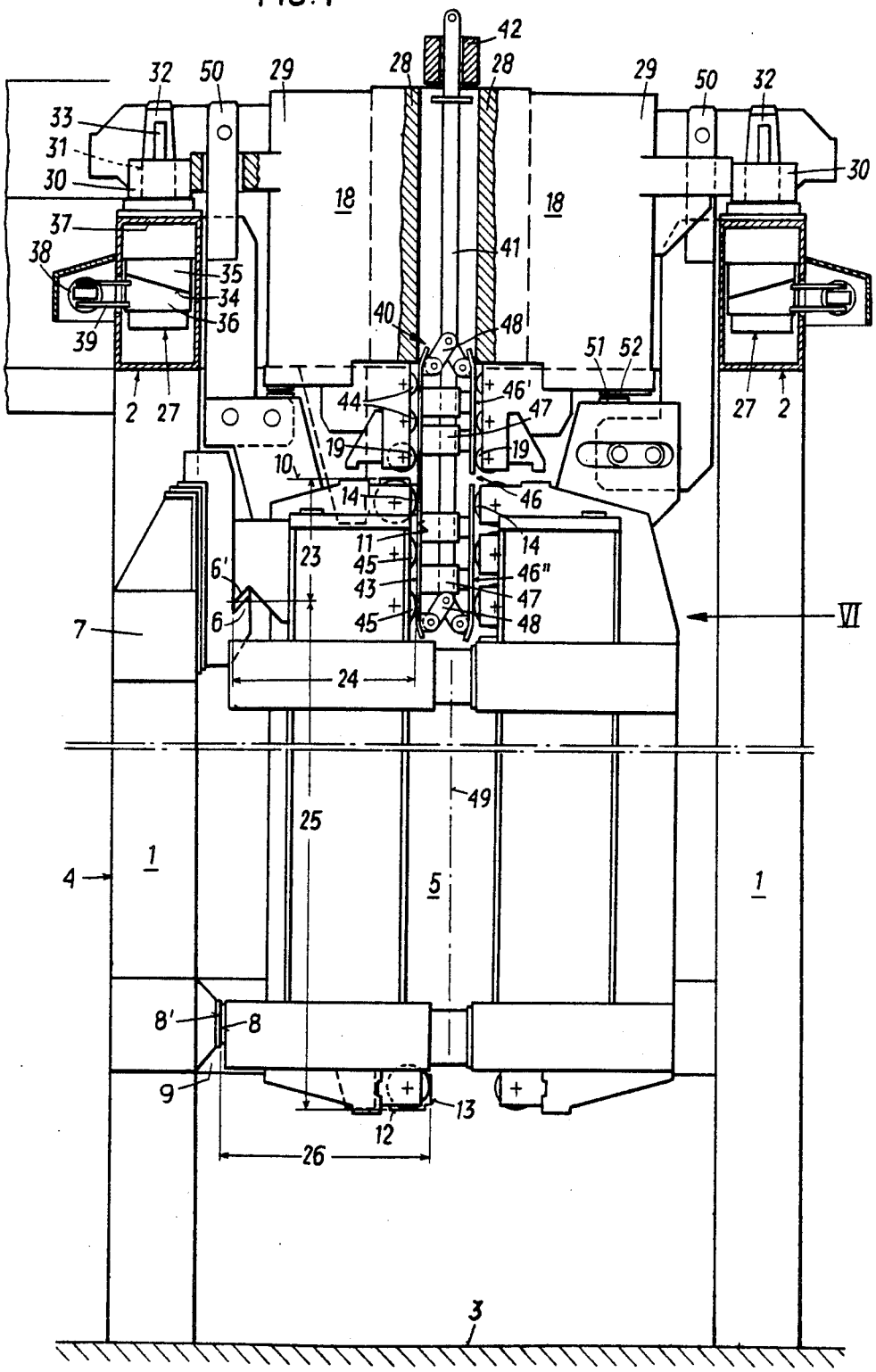
FIGS. 4 to 6 illustrate a second embodiment of the present invention in illustrations analogous to FIGS. 1 to 3.
Figure 6:
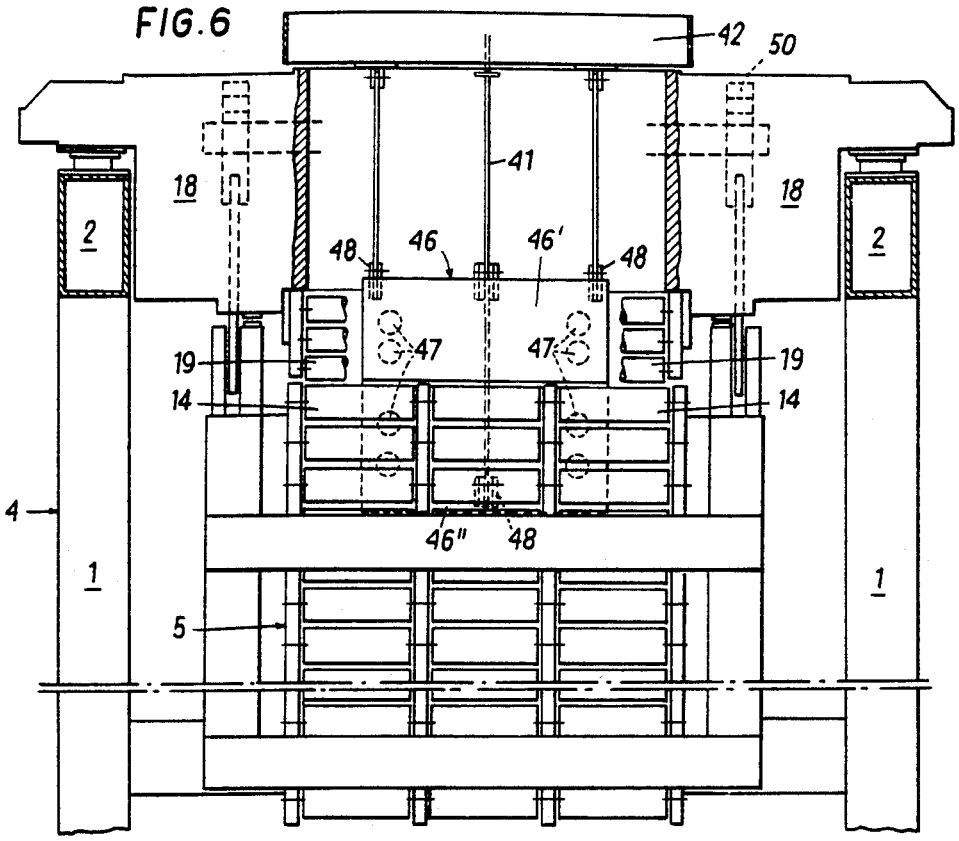
Figure 5:
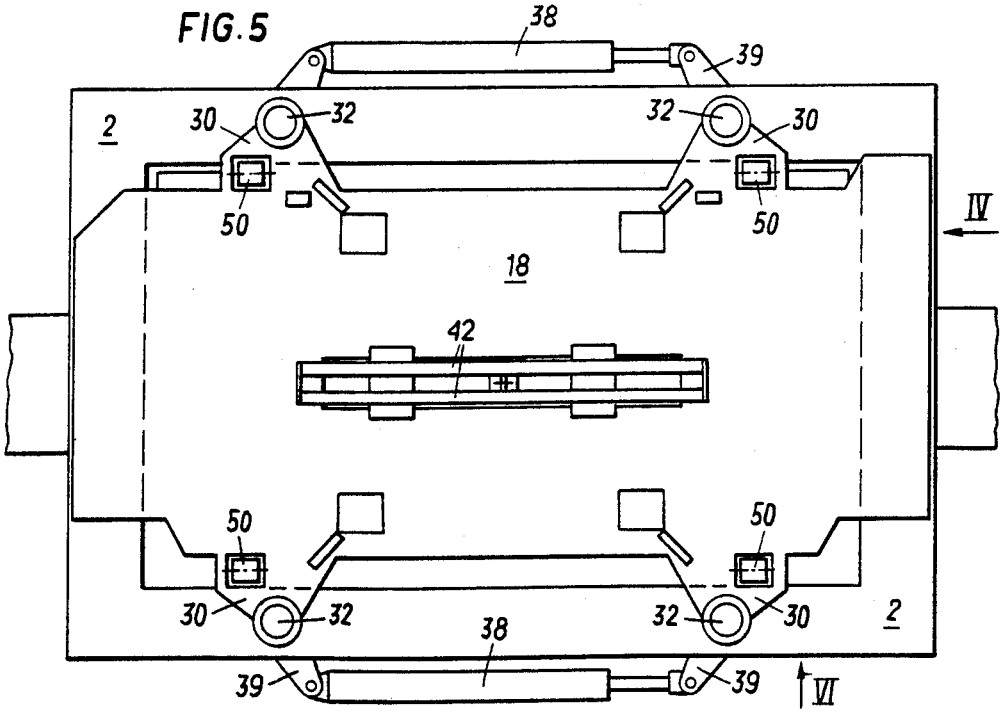

The embodiment illustrated in FIGS. 4 to 6 is designed in the same manner as the cage 4 represented in FIGS. 1 to 3, with the difference that the mould is fixable on the upper transverse carriers representing the lifting table, by means of four quicklocks 27. The mould 18, i.e., the carrying frame 29 supporting the walls 28 of the mould, is supported on the upper transverse carriers 2 by means of four consoles 30 fastened to it, two of which are each arranged on one side of the mould. These consoles each comprise bores 31 on their ends, which are penetrated by pins 32 arranged on the transverse carriers 2. Insert pieces 33 extending transversely through the pins over the consoles serve to fix the mould on the aligning stand. Each of the pins 32 is clampable against a console 30 with its insert piece 33 by means of a quicklock 27. To this end, each quicklock comprises two bushes 35, 36 adjacently arranged with helical surfaces 34, one of which (bush 35) is rigidly mounted to the pin 32 and the bush 36, which is arranged between this bush 35 and the upper cover plate 37 of the transverse carrier 2, is pivotable by a pressure medium cylinder 38. Two rotatable bushes arranged on one side of the mould are each connected via levers 39 by means of a single pressure medium cylinder.

The adjustment of the mould 18 in this case is not effected from a fixed side, but the position of the mould is merely dependent on the position of the bending zone 5, i.e., the mould 18 is exactly aligned with the bending zone 5. The adjustment of the position of the bending zone relative to its suspension means, in turn, is effected by measuring the first and the last roller of the bending zone, as is described above in respect of the embodiment illustrated in FIGS. 1 to 3. To align the mould or to alignedly adjust two strand guide sections of a continuous casting plant neighboring in the strand flow direction, a centering means 40 serves as is described in the U.S. patent application Ser. No. 366,928 of 1982. This centering means 40 is suspendible on the upper side of the mould 18 by means of guide rods 41 and a cross plate 42 fastened thereto.

The centering means 40 itself on one side comprises a rigid centering plate 43, which can get into contact with the foot rollers 19, 44 of the mould and with the first rollers 14, 45 of the bending zone 5. Opposite to this rigid centering plate, a further centering plate 46 designed in two parts is provided, whose upper part 46' can get into contact with the foot rollers 19, 44 of the mould and whose lower part 46" can get into contact with the first rollers 14, 45 of the bending zone 5. By straddling means designed as pressure medium cylinders 47, the centering plates 45, 46 are pressable against the guideways, i.e., against the rollers forming these guideways. In order to prevent the opposite centering plates from falling asunder, the centering plates are hinged to each other by articulation brackets 48.

The arrangement functions in the following manner:

In order to adjust the mould 18 to be in alignment with the bending zone 5, the centering means 40 is threaded in through the mould after previous measuring and possible correction of the position of the bending zone 5 and after placing the mould 18 onto the transverse carriers 2, the straddling means 47 being relieved. By actuation of the straddling means 47—at first the straddling means of the lower part 46" of the centering plate 46 and then the straddling means of the upper part 46' of the centering plate 46 are actuated—the mould 18 is displaced into a position in alignment with the bending zone 5 by sliding the consoles 30 on the transverse carriers 2 transversely to the axis 49 of the bending zone 5. Then, the mould 18 and the bending zone 5 are commonly inserted into the continuous casting plant by seizing the bending zone 5 with a crane suspension suspended into carrying brackets 50 of the bending zone, which reach as far as to the upper side of the mould 18. Thereby, supporting surfaces and counter supporting surfaces 51, 52 arranged on the bending zone and on the mould get into contact with each other. The mould 18, during this procedure, rests in an aligned position relative to the bending zone 5 on account of the centering means 40.

After the common insertion of the bending zone 5 and the mould 18 into the continuous casting plant, the bending zone 5 is fastened to the steel structure of the continuous casting plant. Thereby, the mould gets into contact with the lifting table (not illustrated) via its four carrying brackets 30, which lifting table is designed in the same manner as the transverse carriers 2 of the aligning stand 4, whereupon the mould is fastened on the lifting table by actuation of the quicklocks also provided on the lifting table and after preivous insertion of the insert pieces into the recesses of the pins of these quicklocks. When placing the mould on the lifting table, the supporting and counter supporting surfaces 51, 52 of the mould 18 and of the bending zone 5, respectively get out of contact so that the mould 18 may reciprocate relative to the bending zone 5 in the direction of its axis. Thereafter, the straddling means 47 of the centering means 40 are relieved, the centering means 40 being upwardly removed from the plant.

What we claim is:

1. In a checking and aligning stand to be used in a continuous casting plant having a strand guide composed of structure sections, and first seats for accommodating each of said structure sections, said structure sections including supporting rollers forming rollerways, said checking and aligning stand serving to measure and align said structure sections for positioning in said strand guide and including second seats defining a position of at least one structure section and means for determining the position of said supporting rollers of said at least one structure section, the improvement wherein second seats are provided in said checking and aligning stand in positions corresponding to said first seats of said continuous casting plant strand guide, and wherein said means for determining the position of said supporting rollers include at least one pair of measuring surfaces provided in the region of said second seats and arranged at an angle relative to each other for determining a set of coordinates of said rollerway relative to said second seats of said checking and aligning stand and defining the position of said structure section.

2. A checking and aligning stand as set forth in claim 1, wherein said measuring surfaces are arranged at an angle of 90°.

3. A checking and aligning stand as set forth in claim 1, wherein said measuring surfaces are comprised of horizontal and vertical measuring surfaces.

4. A checking and aligning stand as set forth in claim 1, further comprising a plurality of upright standards, said second seats of said checking and aligning stand being provided on said upright standards, and consoles fastened to said upright standards and projecting toward said at least one structure section, said at least one pair of measuring surfaces being provided on said consoles.

5. A checking and aligning stand as set forth in claim 1, wherein one of said structure sections is a mould, and wherein at least one pair of said measuring surfaces incudes a horizontal surface and a vertical surface for locating a mounting position of said mould.

* * * * *